US009279576B2

(12) United States Patent
Guercio et al.

(10) Patent No.: US 9,279,576 B2
(45) Date of Patent: Mar. 8, 2016

(54) LIGHT FIXTURE WITH INTERCHANGEABLE HEATSINK TRAYS AND REFLECTORS

(71) Applicant: RAB Lighting Inc., Northvale, NJ (US)

(72) Inventors: Vincenzo Guercio, Wallkill, NY (US); Jiang Hu, Shanghai (CN)

(73) Assignee: RAB Lighting Inc., Northvale, NJ (US)

( * ) Notice: Subject to any disclaimer, the term of this patent is extended or adjusted under 35 U.S.C. 154(b) by 273 days.

(21) Appl. No.: 13/647,919

(22) Filed: Oct. 9, 2012

(65) Prior Publication Data

US 2013/0088865 A1 Apr. 11, 2013

Related U.S. Application Data

(60) Provisional application No. 61/545,284, filed on Oct. 10, 2011.

(51) Int. Cl.

| | |
|---|---|
| ***F21V 29/00*** | (2015.01) |
| ***F21V 7/04*** | (2006.01) |
| ***F21V 17/00*** | (2006.01) |
| ***F21V 19/04*** | (2006.01) |
| ***F21V 29/507*** | (2015.01) |
| ***F21V 29/71*** | (2015.01) |
| *F21Y 101/02* | (2006.01) |
| *F21V 31/00* | (2006.01) |

(52) U.S. Cl.

CPC ..... *F21V 29/004* (2013.01); *F21V 7/04* (2013.01); *F21V 17/002* (2013.01); *F21V 19/045* (2013.01); *F21V 29/2212* (2013.01); *F21V 29/507* (2015.01); *F21V 29/71* (2015.01); *F21V 17/005* (2013.01); *F21V 31/005* (2013.01); *F21Y 2101/02* (2013.01)

(58) Field of Classification Search

CPC ..... F21V 29/00; F21V 7/04; F21V 29/2212; F21V 17/002; F21V 19/045; F21V 29/507; F21V 29/71; F21V 31/005; F21V 17/005; F21S 4/00; F21S 2/00; F21Y 2101/02

USPC ..... 362/294, 285, 287, 284, 240, 373; 257/88, 98, 99

See application file for complete search history.

(56) References Cited

U.S. PATENT DOCUMENTS

| | | | | |
|---|---|---|---|---|
| 6,661,665 | B2 * | 12/2003 | Tantoush et al. | 361/719 |
| 7,104,672 | B2 | 9/2006 | Zhang | |
| 7,163,324 | B2 | 1/2007 | Pederson | |
| 7,234,844 | B2 | 6/2007 | Bolta et al. | |
| 7,322,718 | B2 | 1/2008 | Setomoto et al. | |
| 7,344,279 | B2 | 3/2008 | Mueller et al. | |
| 7,344,296 | B2 * | 3/2008 | Matsui et al. | 362/652 |
| 7,387,403 | B2 | 6/2008 | Mighetto | |
| 7,582,911 | B2 | 9/2009 | Lynch et al. | |
| 7,766,511 | B2 | 8/2010 | Zampini et al. | |

(Continued)

*Primary Examiner* — Anh Mai
*Assistant Examiner* — Glenn Zimmerman
(74) *Attorney, Agent, or Firm* — SmithAmundsen LLC; Kelly J. Smith; Dennis S. Schell

(57) ABSTRACT

An illustrative lighting system provides a single light housing and an associated lens cover that together interchangeably receive one of a selection of heat sink trays and one of a selection of light reflectors. Each of the selection of heat sink trays includes a different number and/or orientation of light emitter packages. Each the selection of light reflectors includes openings and surfaces matching the number and orientation of light emitter packages for one of the selection of heat sink trays.

21 Claims, 6 Drawing Sheets

(56) References Cited

U.S. PATENT DOCUMENTS

| | | | | |
|---|---|---|---|---|
| 7,810,951 | B1 | 10/2010 | Lee et al. | |
| 7,841,734 | B2 * | 11/2010 | Wilcox | 362/153 |
| 2006/0227536 | A1 * | 10/2006 | Haugaard et al. | 362/150 |
| 2008/0080188 | A1 * | 4/2008 | Wang | 362/294 |
| 2009/0262530 | A1 * | 10/2009 | Tickner et al. | 362/235 |
| 2009/0267519 | A1 | 10/2009 | Pearse | |
| 2009/0268453 | A1 * | 10/2009 | Pearse | 362/235 |
| 2010/0103668 | A1 * | 4/2010 | Lueken et al. | 362/234 |
| 2010/0177514 | A1 * | 7/2010 | Liu et al. | 362/235 |
| 2010/0203465 | A1 | 8/2010 | Bria et al. | |
| 2010/0238671 | A1 * | 9/2010 | Catone et al. | 362/373 |
| 2011/0128733 | A1 | 6/2011 | Chen et al. | |
| 2011/0170294 | A1 | 7/2011 | Mier-Langner et al. | |
| 2011/0194258 | A1 * | 8/2011 | Kodadek, III | F21V 29/02 361/720 |
| 2011/0304270 | A1 * | 12/2011 | Scarpelli | F21S 4/008 315/113 |
| 2012/0043885 | A1 * | 2/2012 | Lai | 315/35 |

* cited by examiner

LIGHT FIXTURE WITH INTERCHANGEABLE HEATSINK TRAYS AND REFLECTORS

CROSS-REFERENCE TO RELATED APPLICATIONS

This application is a nonprovisional of U.S. Provisional Application No. 61/545,284, filed Oct. 10, 2011, and titled Light Fixture with Interchangeable Heatsink Trays and Reflectors, which is herein entirely incorporated by reference.

BACKGROUND

The present invention relates to light distribution and light emitter cooling features for light fixtures, and particularly, to providing a light fixture with selectable locations, orientations, and quantity of light emitters.

A single light housing design can be used to provide a number of light fixtures providing different lighting features by changing various features of the fixture other than the housing. For example, in incandescent and fluorescent light fixtures, variations in fixtures with the same housing are sometimes provided by using a variety of bulb wattages or quantities, or by including an adjustable reflector and/or shade that varies the light distribution pattern.

Managing the temperature of light sources in a light fixture is generally important to performance and longevity. This is particularly true with newer highly efficient lighting technology, for example, light sources such as LEDs, laser diodes or other light emitters. LEDs are generally selected to maximize the light output for a given power consumption at a reasonable cost. Because LED light sources operate at a much lower temperature than typical incandescent light sources, less energy is wasted in the form of heat production. However, LEDs tend to be more sensitive to operating temperature and lower operating temperatures also provide a much smaller temperature difference between the LED and the ambient environment, thus requiring greater attention to thermal management to transfer and dissipate any excess heat generated by the LED driver and emitter so that the design operating temperature for the components are not exceeded.

LED light fixtures generally include both LED drivers and LED emitters. Limiting the operating temperature is most critical for the LED emitter. As temperatures rise, the efficacy of the LED is reduced, reducing the light output, and possibly reducing the lifespan of the LED. The LED emitters used in light fixtures are often in the form of an LED package, for example, a package that includes one or more LEDs, a mounting substrate, for example formed from ceramic, and optionally a lens structure.

To facilitate dissipation of heat, convection, conduction, and radiation are available modes of heat transfer. For LED light fixtures, dissipation of heat by conduction is often provided by one or more LED packages being mounted on a heat sink. The heat sink is generally integral with or thermally coupled with the light housing, which often includes external cooling fins to further facilitate the dissipation of heat by convection and radiation.

In prior art LED light fixtures, the heat sinks are often integral with the light housing so that the heat is efficiently conducted to the outside of the housing where it is then dissipated by convention and radiation; however, in such designs, it can be difficult to thermally isolate the LED driver from the LED emitters. Additionally, such an arrangement also limits the ability to provide a variety of orientations and quantities of LED emitters for a single light housing design, as each LED package is generally coupled directly to the heat sinks, and the heat sinks are generally fixed by the integral design with the housing.

In some prior art LED light fixtures, various mechanical features are used to provide selectable orientations and quantities of LED lights; however, these features can be a limitation in dissipating heat by conduction and/or can introduce unwelcome complexity and cost.

For example, to provide a selectable orientation for LED packages, one prior art design utilizes LED packages coupled by springs to mounting posts that extend from a heat sink, the elevation of the combination of springs on the posts determining the orientation of the LED package; however, this design requires heat pipes that couple the LED packages to the heat sinks. Another prior art design provides several LEDs mounted on a rotatable mounting brackets; however, the mounting bracket and rotation mechanism limits heat conduction to the external surfaces of the light housing were heat can be dissipated.

Other prior art light fixture designs include a cylindrical heat sink. The outer circumference of the cylindrical heat sink forms several flat surfaces around its circumference. Each flat surface receives one of a variety of different LED packages that can be each selected based on a desired LED intensity for the direction in which that particular LED package will be oriented. To facilitate dissipation of heat from the LEDs in this prior art design, the inside of the cylindrical heat sink forms inwardly protruding cooling fins. This cooling structure arrangement has the disadvantage that the light housing is open to the environment in order to allow air to follow through the center of the cylindrical heat sink. Additionally, the same heat sink surface and associated mass is used to receive each LED package, regardless of the amount of heat that needs to be dissipated from the particular LED package coupled to that heat sink surface and associated mass.

Therefore, it is desirable to provide a light fixture design having a single housings that can provide multiple LED configurations and appropriate heat sinks and reflectors designed for each LED configuration.

SUMMARY

The present invention may comprise one or more of the features recited in the attached claims, and/or one or more of the following features and combinations thereof.

An illustrative lighting system provides a single light fixture and an associated lens cover that together interchangeably receive one of a selection of heat sink trays and one of a selection of light reflectors. Each of the selection of heat sink trays includes a different number and/or orientation of light emitter packages. Each the selection of light reflectors includes openings and surfaces matching the number and orientation of light emitter packages for one of the selection of heat sink trays.

An illustrative embodiment of a system for a light fixture includes a light housing defining a tray receptacle; a plurality of light emitter packages; and a plurality of thermally conductive heat sink trays, each of the plurality of heat sink trays interchangeably mountable in the tray receptacle, defining a plurality of mounting pads, and having a plurality of light emitter packages; each of the plurality of light emitter packages mounted on one of the plurality of mounting pads; and wherein the relative orientations of the plurality of mounting pads of one of the plurality of heat sink trays provides a lighting pattern different from that provided by the relative orientations of the plurality of mounting pads of a different one of the plurality of heat sink trays.

One of the plurality of heat sink trays can include a fixed number of mounting pads, and a different one of the plurality of heat sink trays can include a different fixed number of mounting pads. The plurality of mount pads can be integrally formed with a respective one of the plurality of heat sink trays. At least one of the plurality of heat sink trays can define a planar support having a mounting side and a light emitter side. At least one of the plurality of mounting pads can include a convex polyhedron heat sink mass protruding from and integral with the planar support. The light housing can define an interior surface and an exterior surface; the tray receptacle can be defined by a first plurality of alignment features defined by the interior surface; and each heat sink tray can include a second plurality of alignment features engageable with the first plurality of alignment features.

The interior surface of the light housing can adjoin the planar support on a side opposite the plurality of mounting pads, thereby maximizing the conduction of heat from the plurality of light emitters to the exterior surface of the light housing. The exterior surface of the light housing can define a plurality of cooling fins.

The light fixture can further include a plurality of light reflectors, each of the plurality of light reflectors interchangeably couplable with the light housing and defining openings and reflective surfaces matching the quantity and orientations of the plurality of mounting pads of at least one of the plurality of heat sink trays. The light fixture can further include a lens cover coupled with the light housing, the light housing and lens cover enclosing one of the plurality of light reflectors and one of the plurality of heat sink trays.

The plurality of light emitter packages can each include an LED emitter mounted on a planar substrate, the substrate material selected to thermally conduct heat from the LED emitter to an opposite side of the substrate that adjoins one of the plurality of mounting pads.

Another illustrative embodiment of a system for a light fixture includes a light housing defining a tray receptacle; a plurality of light emitter packages; and a plurality of thermally conductive heat sink trays, each of the plurality of heat sink trays interchangeably mountable in the tray receptacle, defining a plurality of mounting pads, and having a plurality of light emitter packages; each of the plurality of light emitter packages mounted on one of the plurality of mounting pads; and wherein one of the plurality of heat sink trays includes a fixed number of mounting pads, and a different one of the plurality of heat sink trays includes a different fixed number of mounting pads.

The relative orientations of the plurality of mounting pads of one of the plurality of heat sink trays can provide a lighting pattern different from that provided by the relative orientations of the plurality of mounting pads of a different one of the plurality of heat sink trays Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DESCRIPTION OF THE ILLUSTRATIVE EMBODIMENTS

Figure 1:
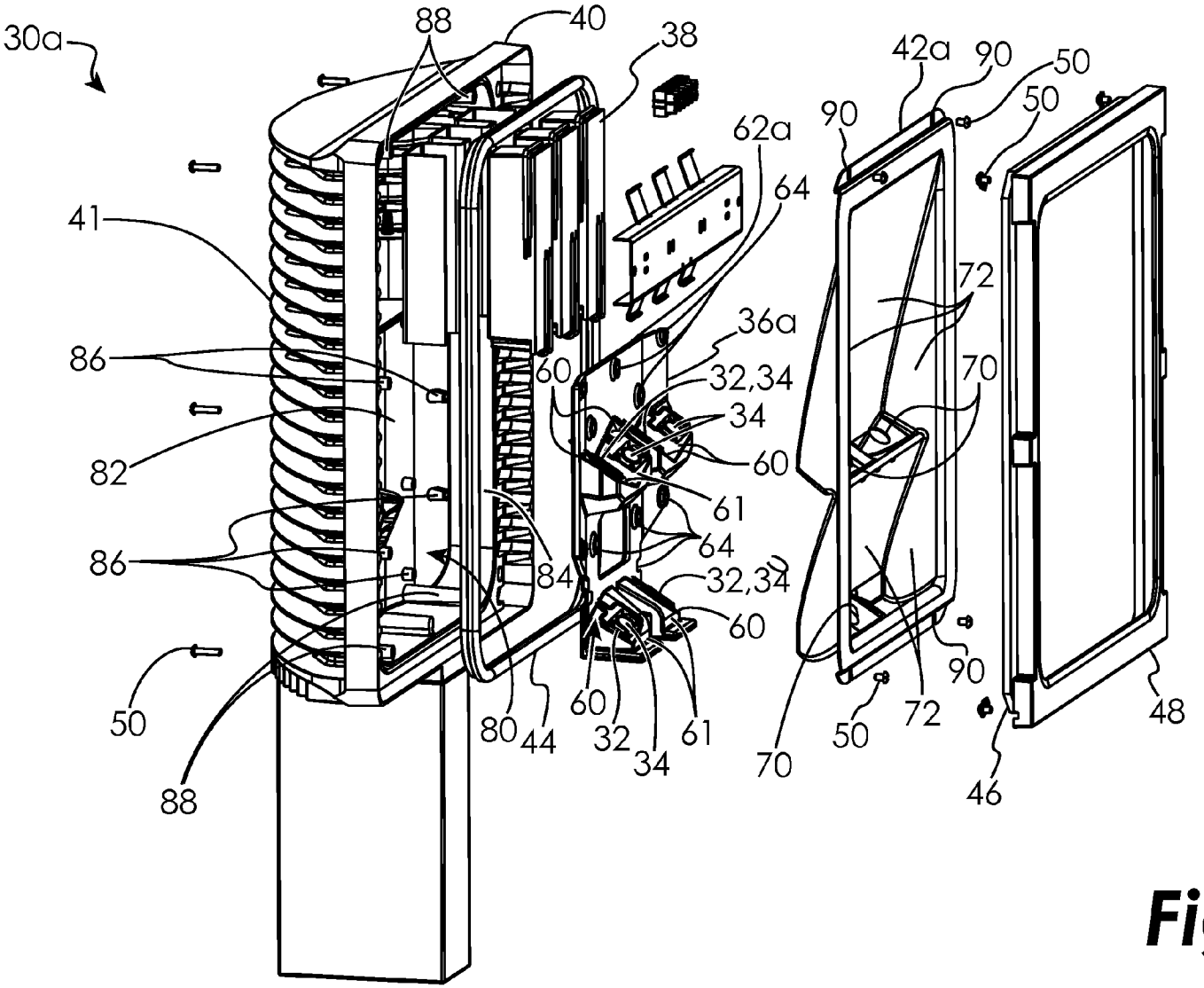
FIG. 1 is an exploded perspective view of an illustrative light fixture having a first illustrative LED heat sink tray and reflector according to the present invention.

For the purposes of promoting and understanding the principals of the invention, reference will now be made to one or more illustrative embodiments illustrated in the drawings and specific language will be used to describe the same.

Figure 2:
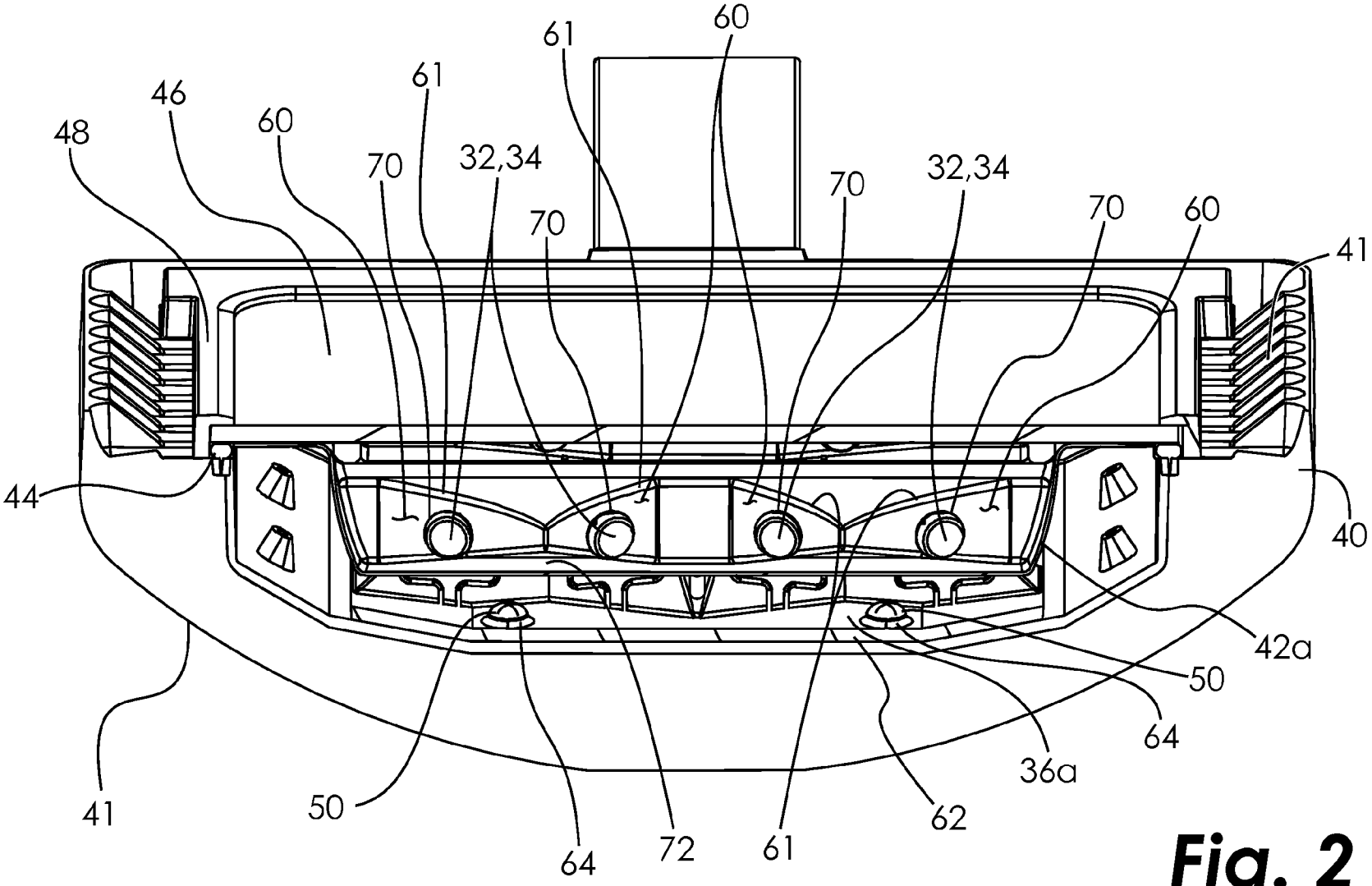
FIG. 2 is a sectional view of the light fixture of FIG. 1, taken along the section line 2-2 shown in FIGS. 3A and 3B.
Figure 3A:
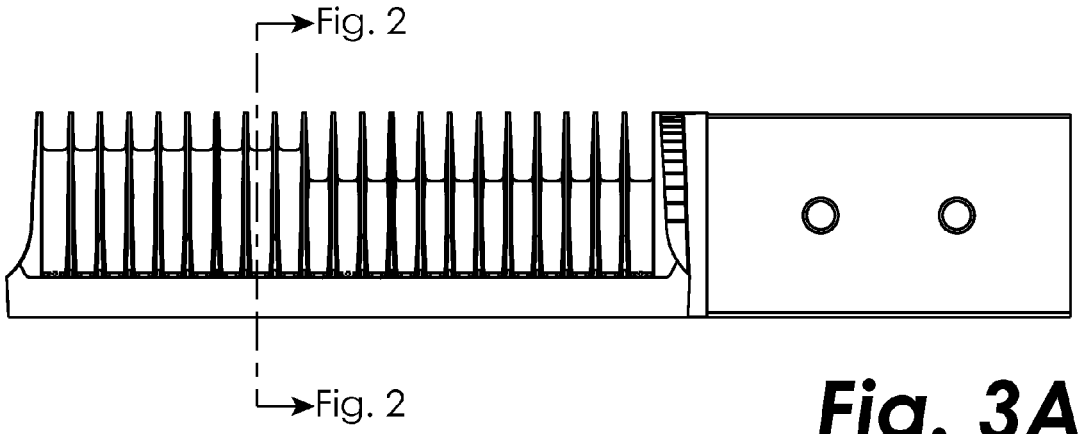
FIG. 3A is an assembled side view of the light fixture of FIG. 1.

Referring to FIGS. 1-3, a first illustrative embodiment of a light fixture 30*a* according to the present invention is illustrated. Referring to FIG. 1, the light fixture 30*a* includes one or more light emitter packages 32, each including an emitter 34 (as used herein, "emitter" refers to a single emitter or an array of emitters). The light fixture 30*a* also includes a heat sink tray 36*a* on which the light emitter packages 32 are mounted, a driver 38 (as used herein, "driver" refers to a single driver or an array of drivers), a light housing 40, light reflector 42*a*, water seal 44, lens 46, frame (door) 48, and fasteners 50 for securing the frame and hood, lens, water seal, light reflector, and heat sink tray to the light housing.

The emitter 34 may be, but is not limited to, an LED emitter as is typically used in the commercial lighting industry in combination with a driver 38. Alternatives to LEDs known in the art include laser diodes. Such emitters are commonly available in a planar array package such as that illustrated for light emitter packages 32 in FIG. 1.

Figure 4:
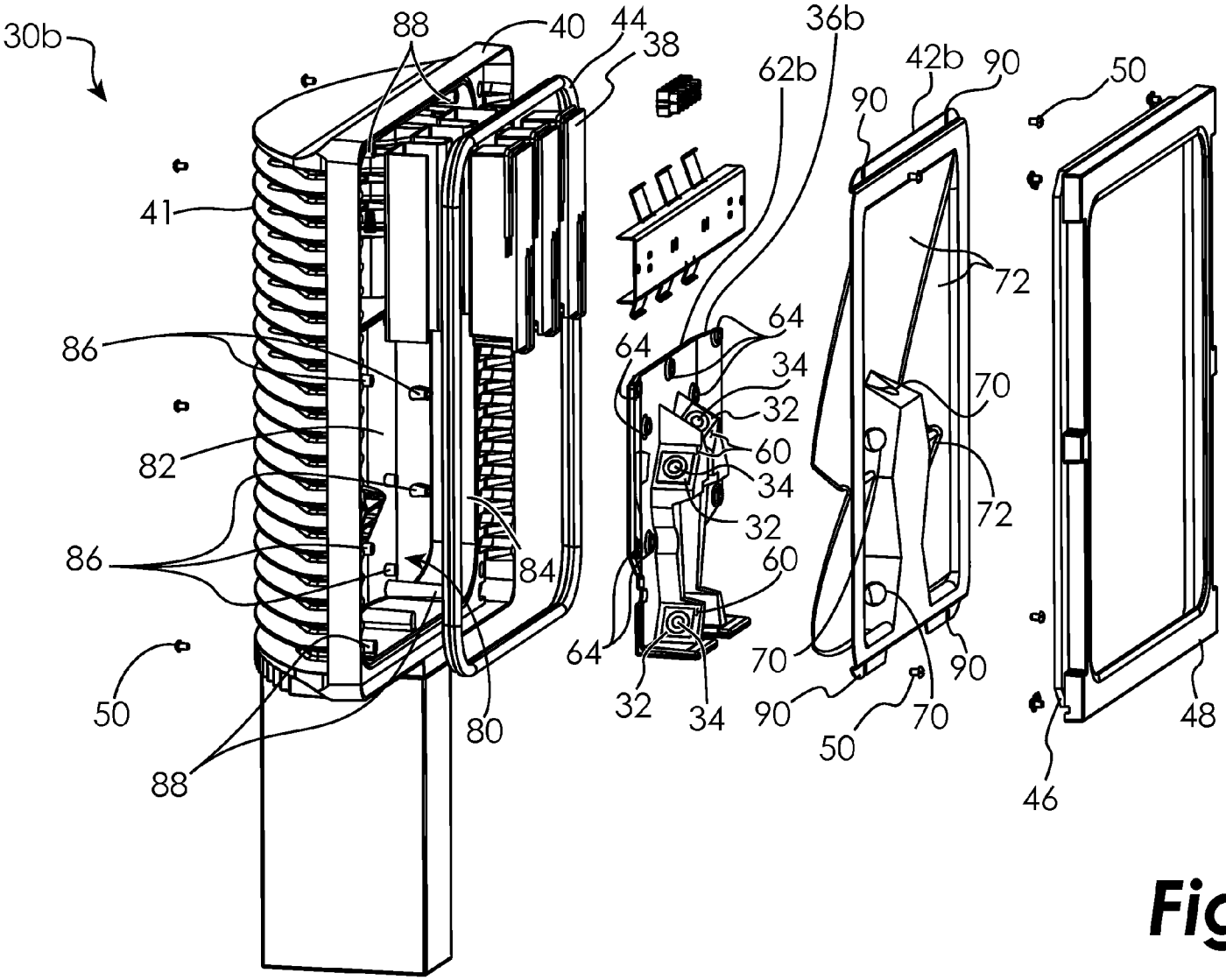
FIG. 4 is an exploded perspective view of the light fixture of FIG. 1 with a second illustrative LED heat sink and reflector according to the present invention.
Figure 5:
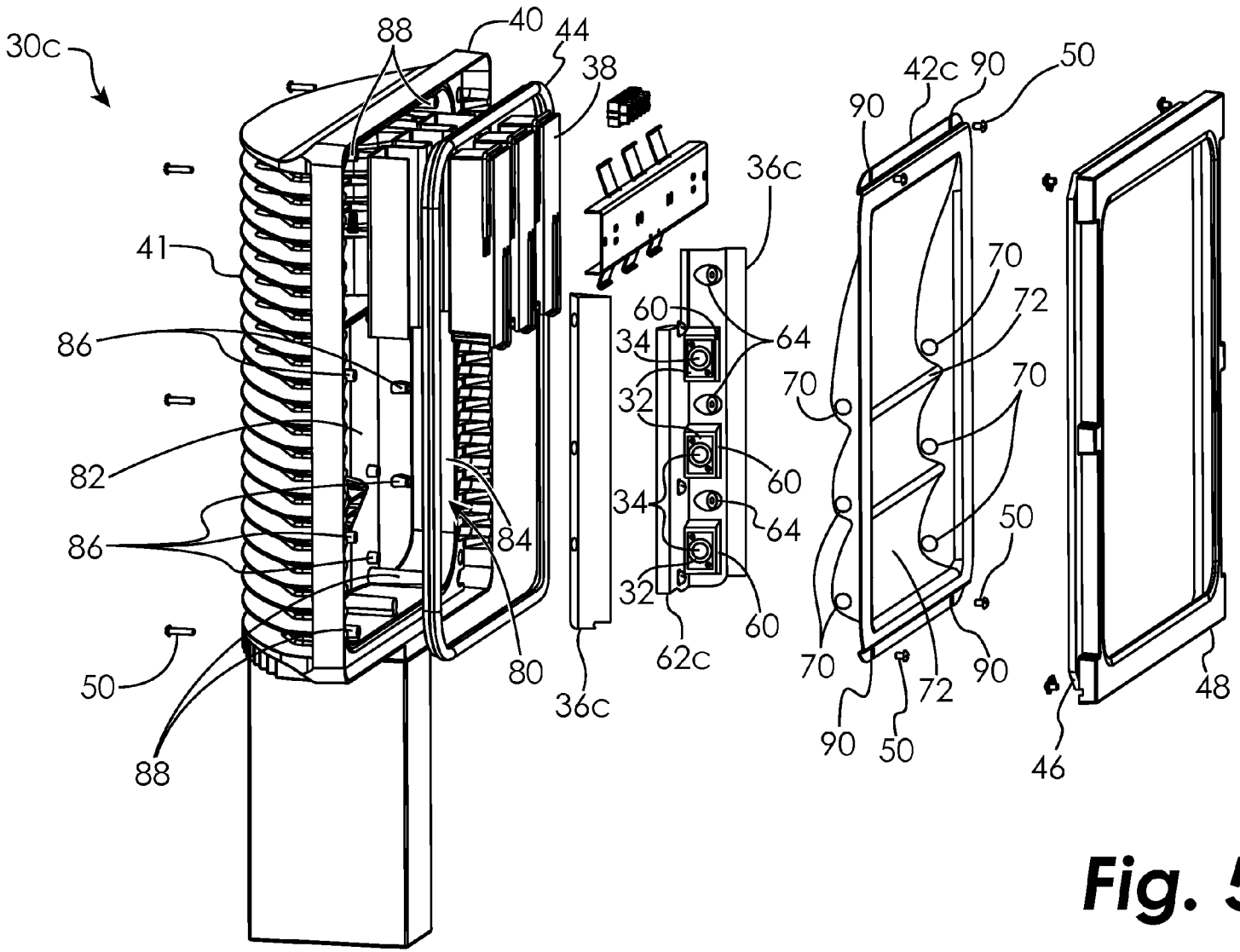
FIG. 5 is an exploded perspective view of the light fixture of FIG. 1 with a third illustrative LED heat sink and reflector according to the present invention.

Referring to FIGS. 1, 4, and 5, the illustrative lighting system provides a variety of light fixtures 30*a*, 30*b*, and 30*c*, each providing a different lighting distribution while using a single common light housing 40 and single common associated components, for example the driver 38, water seal 44, lens 46, frame 48, and fasteners 50. The light housing 40 and associated components can interchangeably receive any one of the heat sink trays 36*a*, 36*b*, or 36*c*, and matching light reflector 42*a*, 42*b*, or 42*c*. The light housing 40 and heat sink tray 36*a-c* can be, for example, die cast from aluminum or an aluminum alloy, or formed from another thermally conductive material. The light reflector 42 can be, for example, a stamping formed from aluminum or an aluminum alloy.

For example, in the illustrated lighting system, each heat sink tray 36*a*-36*c* includes a different number and/or orientation of mounting pads 60. Mounting pads 60 receive and orient the light emitter packages 32, as can be seen by comparing heat sink trays 36*a*-36*c* in FIGS. 1, 4, and 5. Additionally, mounting pads 60 thermally conduct heat away from emitter packages 32 through heat sink tray 36*a*-36*c*, and to exterior fins 41 of the light housing 40.

Figure 3B:
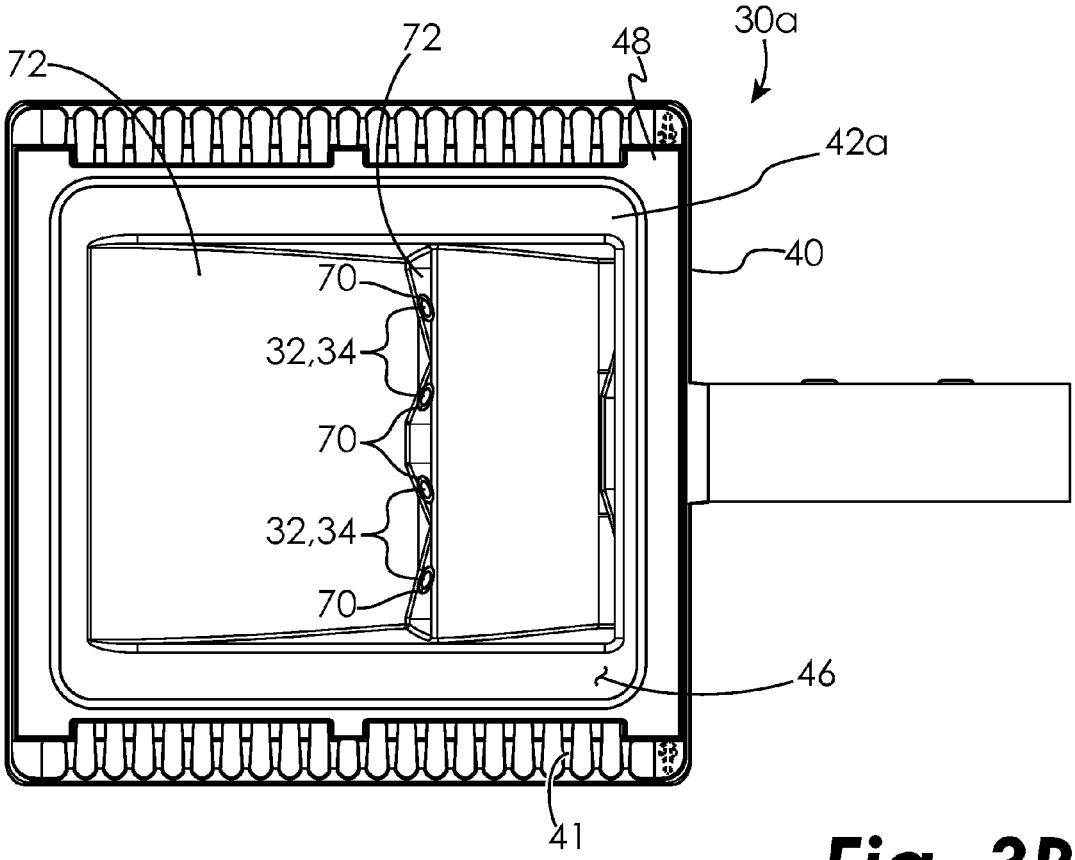
FIG. 3B is an assembled bottom view of the light fixture of FIG. 1.

Each light reflector 42*a*-42*c* defines openings 70 and reflective surfaces 72, both located and formed to match the number, location, and orientation of light emitter packages 32 for the respective matching one of heat sink tray 36*a*-36*c*. For example, as shown in FIG. 3B, the openings 70 and surfaces 72 of light reflector 42*a* are defined such that the light emitter packages 32 are located adjacent to or contacting a rear surface (not shown) of the reflector around openings 70, thus exposing emitters 34 through the openings 70. Additionally, the reflective surfaces 72 are defined to provided the desired light distribution for each emitter package 32.

Advantageously, in the illustrative lighting system, a single housing 40, associated lens 46, frame 48, and other associated components are all common parts used in all of light fixtures 30*a*-30*c*, while a selected one of interchangeable heat sink trays 36*a*-36*c* and associated light reflectors 42*a*-42*c* are selected for each light fixture 30*a*, 30*b*, or 30*c*, to provide a desired lighting distribution for that fixture. Lighting distributions can include, but are not limited to, the intensity and/or pattern of light provided by the light fixtures.

An interior space within the light housing 40 defines a tray receptacle 80. The tray receptacle 80 interchangeable receives any one of the heat sink trays 36*a*-36*c* and associated reflector 42*a*-42*c*. In the illustrative embodiment of light housing 40, the tray receptacle 80 is defined by the open space formed within the interior rear surface 82 and interior sidewalls 84 of the light housing 40.

Figure 6:
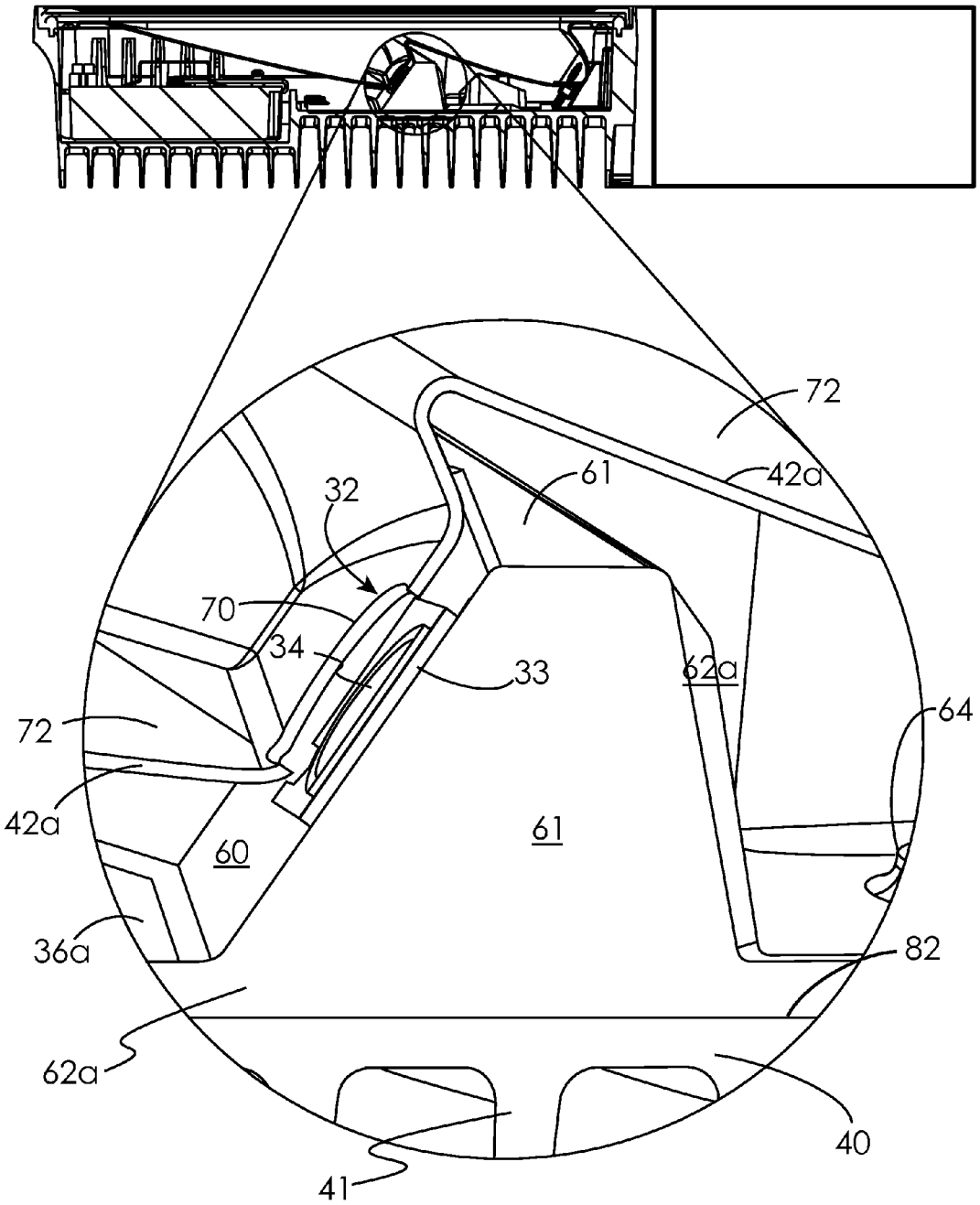
FIG. 6 is a side perspective cross-sectional view of an emitter, mounting pad, and thermal mass of the light fixture and first illustrative LED heat sink and reflector of FIG. 1.

As shown best in and cross-sectional assembly view FIG. 6, and also shown in exploded perspective views FIGS. 1, 4, and 5, heat sink trays 36*a*-36*c* include mount pads 60, and in the illustrated embodiment shown in FIG. 6, the mounting pads 60 are each defined as a planar surface of a heat sink mass 61. Heat sink mass 61 can be, for example, a convex polyhedron configured to function as a thermal mass to dissipate and transfer heat from the emitter package 32. The heat sink masses 61 can be integrally formed with the planar body 62*a* of the heat sink tray 36*a*. Alternatively, each of the heat sink masses 61 can be coupled to the planar body 62*a*, for example, with adhesive or other fasteners known in the art. In some embodiments of the integrally formed embodiment of heat sink tray 36*a*, the heat sink masses 61 are highly thermally conductive with the planar body 62*a*, and the planar body 62*a* adjoins an interior surface 82 of housing 40, for example, by being in direct contact with and have having little to no air or other thermal gap between the planar body 62*a* and interior surface 82, as shown in cross-sectional view FIG. 6. Advantageously, this arrangement maximizes the conduction of heat away from the light emitter packages 32 and to the external cooling fins 41 of the light housing 40.

Alternatively, in other embodiments, the heat sink masses 61 are partially or fully thermally isolated from the heat sink tray 42*a*, for example, by separating with a thermal insulator, or the heat sink tray 42*a* being partially or fully thermally isolated from the light housing 40, for example, by providing an air gap or other thermal insulator between an interior surface 82 of the housing and the planar body 62*a*, for example, by the alignment features 86 providing standoff spacing between the housing 40 and heat sink tray 42*a*.

The heat sink trays 36*a*-36*c* each have one or more second alignment features 64 that correspond and cooperate with one or more of the first alignment features 86. For example, as shown in FIG. 2, the planar body 62*a* of the heat sink tray 42*a* defines the second alignment features 64 as recesses which include a through hole for securing heat sink tray 42*a* with fasteners 50, for example pan head screws, that screw into or otherwise anchor with the first alignment features 86, in this embodiment posts protruding from the interior rear surface 82 and defining threaded bores therein. In some embodiments, a particular one of the heat sink trays 36*a*-36*c* may use only a subset of all of the alignment features 86 provided by the housing fixture 40.

In some embodiments, the alignment features 86 and 64 and fasteners 50 are designed to maximize conductive heat transfer from the heat sink tray 36*a* to the light housing 40 and external fins 41 defined by the housing. For example, alignment features 86 and 64 can provide a large direct contact area, including between the heat sink tray 36*a* and the interior surface 82 of the housing 40, to maximize conductive heat transfer away from the emitter packages 32. Alternatively, in some embodiments, the alignment features 86 and 64 and fasteners 50 are designed to minimize conductive heat transfer from the heat sink tray 42*a* to the light housing 40 and external fins 41 defined by the housing. For example, alignment features 86 and 64 can provide small direct contact area to minimize conductive heat transfer, and additionally or alternatively, a thermal insulator can be located between alignment features 86 and 64.

In other embodiments, the alignment features 86 and 64 providing positioning and/or securing of the heat sink tray 36*a*-36*c* and/or reflectors 42*a*-42*c* may include, for example, posts, tabs, blocks, peripheral features such as rims or flanges, openings including recesses, protruding and/or recessed contoured surfaces, or other alignment features known in the art to align and/or secure two parts.

Similar to mounting of the heat sink trays 36*a*-36*c* to the light housing 40, the light housing 40 includes third alignment features 88, for example, in this embodiment standoff posts protruding from the interior rear surface 82 and defining threaded bores therein. The reflectors 42*a*-42*c* each have one or more fourth alignment features 90 that correspond and cooperate with one or more of the first alignment features 88. For example, as shown in FIG. 1, the reflector 42*a* defines through holes for fourth alignment feature 90 for securing the reflector with fasteners 50, for example pan head screws, that screw into or otherwise anchor to the third alignment features 88. In some embodiments, a particular one of the reflectors 42*a*-42*c* may use only a subset of all of the alignment features 88 provided by the housing fixture 40. In other embodiments, the alignment features may be other structures known in the art, for example, those discussed above for the heat sink trays 36*a*-36*c*.

Referring to FIG. 4, the second illustrative embodiment of the light fixture 30*b*, includes interchangeable heat sink tray 30*b* in the tray receptacle 80, and interchangeable light reflector 42*b*. Similarly, referring to FIG. 5, the third illustrative embodiment of the light fixture 30*c*, includes interchangeable heat sink tray 30*c* in the tray receptacle 80, and interchangeable light reflector 42*c*. In these embodiments, the heat sink trays 30*b* and 30*c* include the same number of light emitter packages 32; however, the positions and orientations of the mounting pads 60, and thus the positions and orientations of light emitters 34 are different for each heat sink tray 36*a*-36*c*. Similarly, the associated respective light reflector 42*a*-42*c* for each of heat sink tray 36*a*-36*c* has openings 70 and surfaces 72 designed to match the positions and orientations of the light emitter packages 32. In other embodiments (not shown) the number of light emitter packages 32 and mounting pads 60 is different for different heat sink trays. Additionally, in other embodiments, only a subset of the mounting pads 60 are populated with light emitter packages 32, providing a desired lighting distribution.

While the invention has been illustrated and described in detail in the foregoing drawings and description, the same is to be considered as illustrative and not restrictive in character, it being understood that only illustrative embodiments thereof have been shown and described and that all equivalents and all changes and modifications known in the art that come within the spirit and scope of the invention as defined herein are desired to be protected.

The invention claimed is:

1. A light fixture, comprising:

a light housing defining a tray receptacle; and a plurality of different thermally conductive heat sink trays, each of the plurality of heat sink trays:

being interchangeably mountable in the tray receptacle;

defining a plurality of discontiguous mounting pads;

having a plurality of light emitter packages; and providing a different lighting pattern than a different one of the plurality of heat sink trays;

wherein each of the plurality of light emitter packages is mounted on one of the plurality of mounting pads, and wherein the number of light emitter packages matches the number of mounting pads;

wherein the relative orientations of the plurality of mounting pads and light emitter packages of one of the plurality of heat sink trays are different than the relative orientations of the plurality of mounting pads and light emitter packages of a different one of the plurality of heat sink trays.

2. The light fixture of claim 1, wherein one of the plurality of heat sink trays includes a fixed number of mounting pads, and a different one of the plurality of heat sink trays includes a different fixed number of mounting pads.

3. The light fixture of claim 1, wherein the plurality of mounting pads are integrally formed with a respective one of the plurality of heat sink trays.

4. The light fixture of claim 1, wherein at least one of the plurality of heat sink trays defines a planar support having a mounting side and a light emitter side.

5. The light fixture of claim 1, further comprising a plurality of light reflectors, each of the plurality of light reflectors interchangeably couplable with the light housing and defining openings and reflective surfaces matching the quantity and orientations of the plurality of mounting pads of at least one of the plurality of heat sink trays.

6. The light fixture of claim 1, further comprising a lens cover coupled with the light housing, the light housing and lens cover enclosing one of the plurality of light reflectors and one of the plurality of heat sink trays.

7. The light fixture of claim 1, wherein the plurality of light emitter packages each include an LED emitter mounted on a planar substrate, the substrate material selected to thermally conduct heat from the LED emitter to an opposite side of the substrate that adjoins one of the plurality of mounting pads.

8. The light fixture of claim 1, wherein the plurality of mounting pads are integrally formed with a respective one of the plurality of heat sink trays.

9. The light fixture of claim 1, wherein at least one of the plurality of heat sink trays defines a planar support having a mounting side and a light emitter side.

10. The light fixture of claim 4, wherein at least one of the plurality of mounting pads includes a convex polyhedron heat sink mass protruding from and integral with the planar support.

11. The light fixture of claim 4, wherein:

the light housing defines an interior surface and an exterior surface;

the tray receptacle is defined by a first plurality of alignment features defined by the interior surface; and each heat sink tray includes a second plurality of alignment features engageable with the first plurality of alignment features.

12. The light fixture of claim 9, wherein at least one of the plurality of mounting pads includes a convex polyhedron heat sink mass protruding from and integral with the planar support.

13. The light fixture of claim 9, wherein:

the light housing defines an interior surface and an exterior surface;

the tray receptacle is defined by a first plurality of alignment features defined by the interior surface; and each heat sink tray includes a second plurality of alignment features engageable with the first plurality of alignment features.

14. The light fixture of claim 11, wherein the interior surface of the light housing adjoins the planar support on a side opposite the plurality of mounting pads, thereby maximizing the conduction of heat from the plurality of light emitters to the exterior surface of the light housing.

15. The light fixture of claim 11, wherein the exterior surface of the light housing defines a plurality of cooling fins.

16. The light fixture of claim 13, wherein the interior surface of the light housing adjoins the planar support on a side opposite the plurality of mounting pads, thereby maximizing the conduction of heat from the plurality of light emitters to the exterior surface of the light housing.

17. The light fixture of claim 13, wherein the exterior surface of the light housing defines a plurality of cooling fins.

18. A light fixture, comprising:

a light housing defining a tray receptacle; and a plurality of different thermally conductive heat sink trays, each of the plurality of heat sink trays:

being interchangeably mountable in the tray receptacle;

defining a plurality of discontiguous mounting pads;

providing a different lighting pattern than a different one of the plurality of heat sink trays; and having a plurality of light emitter packages;

wherein each of the plurality of light emitter packages is mounted on one of the plurality of mounting pads;

wherein each of the mounting pads is a planar surface of a heat sink mass;

wherein one of the plurality of heat sink trays includes a fixed number of mounting pads, and a different one of the plurality of heat sink trays includes a different fixed number of mounting pads.

19. The light fixture of claim 18, wherein the relative orientations of the plurality of mounting pads of one of the plurality of heat sink trays provides a lighting pattern different from that provided by the relative orientations of the plurality of mounting pads of a different one of the plurality of heat sink trays.

20. The light fixture of claim 18, further comprising a plurality of light reflectors, each of the plurality of light reflectors interchangeably couplable with the light housing and defining openings and reflective surfaces matching the quantity and orientations of the plurality of mounting pads of at least one of the plurality of heat sink trays.

21. A light fixture, comprising:

a light housing defining a tray receptacle; and a plurality of different thermally conductive heat sink trays, each of the plurality of heat sink trays:

interchangeably mountable in the tray receptacle;

having a planar body;

defining a plurality of discontiguous mounting pads integral with and extending from one side of the planar body;

providing a different lighting pattern than a different one of the plurality of heat sink trays; and having at least one light emitter package mounted on one of the plurality of mounting pads;

wherein the relative orientations of the plurality of mounting pads of one of the plurality of heat sink trays are different from the relative orientations of the plurality of mounting pads of a different one of the plurality of heat sink trays.

* * * * *